US007990325B2

(12) United States Patent
Hunton et al.

(10) Patent No.: US 7,990,325 B2
(45) Date of Patent: Aug. 2, 2011

(54) SYSTEM AND METHOD FOR REMOTE ANTENNA POSITIONING DATA ACQUISITION

(75) Inventors: Matthew Hunton, Liberty Lake, WA (US); Nikolai Maslennikov, Huntington Beach, CA (US); Alexander Rabinovich, Cypress, CA (US)

(73) Assignee: Powerwave Technologies, Inc., Santa Ana, CA (US)

( * ) Notice: Subject to any disclaimer, the term of this patent is extended or adjusted under 35 U.S.C. 154(b) by 395 days.

(21) Appl. No.: 12/152,728

(22) Filed: May 16, 2008

(65) Prior Publication Data

US 2008/0284669 A1 Nov. 20, 2008

Related U.S. Application Data

(60) Provisional application No. 60/930,842, filed on May 18, 2007.

(51) Int. Cl.
*H01Q 1/00* (2006.01)

(52) U.S. Cl. ..... 343/720; 343/757; 340/933; 340/937

(58) Field of Classification Search ..... 343/757, 343/765, 766, 720; 340/933, 937, 522
See application file for complete search history.

(56) References Cited

U.S. PATENT DOCUMENTS

| | | | | |
|---|---|---|---|---|
| 5,798,983 | A * | 8/1998 | Kuhn et al. | 367/135 |
| 5,949,303 | A | 9/1999 | Arvidsson et al. | |
| 6,400,903 | B1 * | 6/2002 | Conoval | 396/56 |
| 6,556,916 | B2 * | 4/2003 | Waite et al. | 701/117 |
| 7,541,943 | B2 * | 6/2009 | Manor | 340/937 |
| 2001/0028327 | A1 | 10/2001 | Yamamoto et al. | |
| 2002/0191082 | A1 | 12/2002 | Fujino et al. | |
| 2004/0252197 | A1 | 12/2004 | Fraley et al. | |
| 2006/0017545 | A1 | 1/2006 | Volpi et al. | |
| 2008/0218425 | A1 | 9/2008 | Deng et al. | |

OTHER PUBLICATIONS

U.S. Appl. No. 12/074,980, filed Mar. 7, 2008, Deng et al.
Notification of Transmittal of the International Search Report, and the Written Opinion of the International Searching Authority for International Application No. PCT/US08/06284 dated Jul. 15, 2008, 8 pages.

* cited by examiner

*Primary Examiner* — Hoang V Nguyen
(74) *Attorney, Agent, or Firm* — OC Patent Law Group

(57) ABSTRACT

The present invention provides a remote antenna system employing digital imaging means by which the operator can view both the antenna pointing data and the coverage landscape from the antenna radome perspective. The present invention also provides a method for antenna positioning data acquisition and positioning control employing remotely acquired image data.

19 Claims, 3 Drawing Sheets

SYSTEM AND METHOD FOR REMOTE ANTENNA POSITIONING DATA ACQUISITION

RELATED APPLICATION INFORMATION

The present application claims priority under 35 USC section 119(e) to U.S. Provisional Patent Application Ser. No. 60/930,842 filed May 18, 2007, the disclosure of which is herein incorporated by reference in its entirety.

BACKGROUND OF THE INVENTION

1. Field of the Invention

The present invention relates in general to communication systems and components and related methods of operation. More particularly the present invention is directed to antenna systems for wireless networks and related operation and control methods.

2. Description of the Prior Art and Related Background Information

To optimize signal transmission and reception coverage in wireless markets, systems operators deploy several different antenna types. These antennas differ in the down tilt pointing angle, the azimuth pointing angle, and the coverage beamwidth. Some modern antennas include electrical and mechanical means of adjusting some or all three of these critical antenna parameters. Wireless systems operators often have difficulty during antenna installation, subsequent adjustment, and during normal operation in determining if antenna performance parameters are correctly set and maintained over time. Improper antenna performance leads to poor coverage and hence customer complaints. Currently antenna adjustments often require a site visit and perhaps climbing the antenna tower to insure proper alignment.

Accordingly, many current antenna systems and in particular adjustable antenna systems have either been operated at less than optimal operating parameters over time or had undesirably high maintenance costs.

SUMMARY OF THE INVENTION

The present invention provides a solution to the above noted problems by providing a system and method for remote antenna positioning data acquisition which can be used for antenna performance parameter monitoring and control.

In a first aspect the present invention provides an antenna system adapted for use in a wireless network and for remote position monitoring and control, comprising an antenna, a camera mounted in a fixed relation to the antenna so as to provide a view generally in the direction of the boresight of the antenna beam, and a communication connection coupled to the camera to provide image data from the camera to a remote location.

In a preferred embodiment the antenna system further comprises a radome configured about the antenna and the camera is mounted to the radome. The antenna may comprises plural radiating elements and the communication connection may receive beamwidth control signals provided from the remote location. The communication connection may also receive beam pointing direction control signals provided from the remote location.

In another aspect the present invention provides a method for remote antenna positioning data acquisition. The method comprises acquiring an image of a view from a camera mounted in a fixed relation to an antenna generally in the direction of the boresight of the antenna beam and providing the image data to a remote location.

In a preferred embodiment of the method the image includes position reference information. For example, the position reference information may include a camera pointing direction reference marker and a beam pointing direction reference marker. The method may further comprise adding beam pointing position data in text format to the image data before providing the image data to the remote location. The method may further comprise adding beamwidth information to the image data before providing the image data to the remote location. The method may further comprise using the image data at the remote location to determine antenna beam pointing position relative to desired pointing position. The method may further comprise providing beam pointing adjustment control data to the antenna location from the remote location in response to the determination of antenna beam pointing position information. For example, using the image data at the remote location to determine antenna beam pointing position relative to desired pointing position may comprise comparing the received image data to a prior image to see if the antenna or beam has moved unintentionally requiring correction. The method may further comprise providing beamwidth adjustment control data to the antenna location from the remote location. In a preferred embodiment the antenna is configured within a radome and the camera is mounted to the radome.

In another aspect the present invention provides a method for alignment of an antenna during installation. The method comprises mounting a camera in a fixed relation to an antenna, mounting the antenna and camera to a support structure, acquiring an image from the camera, comparing the pointing direction of the camera to a desired pointing direction corresponding to desired antenna positioning, and adjusting the mounting of the antenna if the image shows a deviation between desired mounting position and actual mounting position.

In a preferred embodiment of the method, mounting a camera in a fixed relation to an antenna comprises mounting the camera to a radome configured about the antenna and mounting the antenna and camera to a support structure comprises mounting the antenna and radome together to the support structure. Mounting the antenna and camera to a support structure may comprise mounting the antenna and radome to a communication tower. Alternatively, mounting the antenna and camera to a support structure may comprise mounting the antenna and radome to a building. In a preferred embodiment of the method acquiring an image from the camera may further comprise providing pointing reference information in the image.

Further aspects and features of the invention are described in the following detailed description.

BRIEF DESCRIPTION OF THE DRAWINGS

The characteristics and advantages of the present invention will be better understood from the following description in conjunction with the attached drawings.

DETAILED DESCRIPTION OF THE INVENTION

Figure 1:
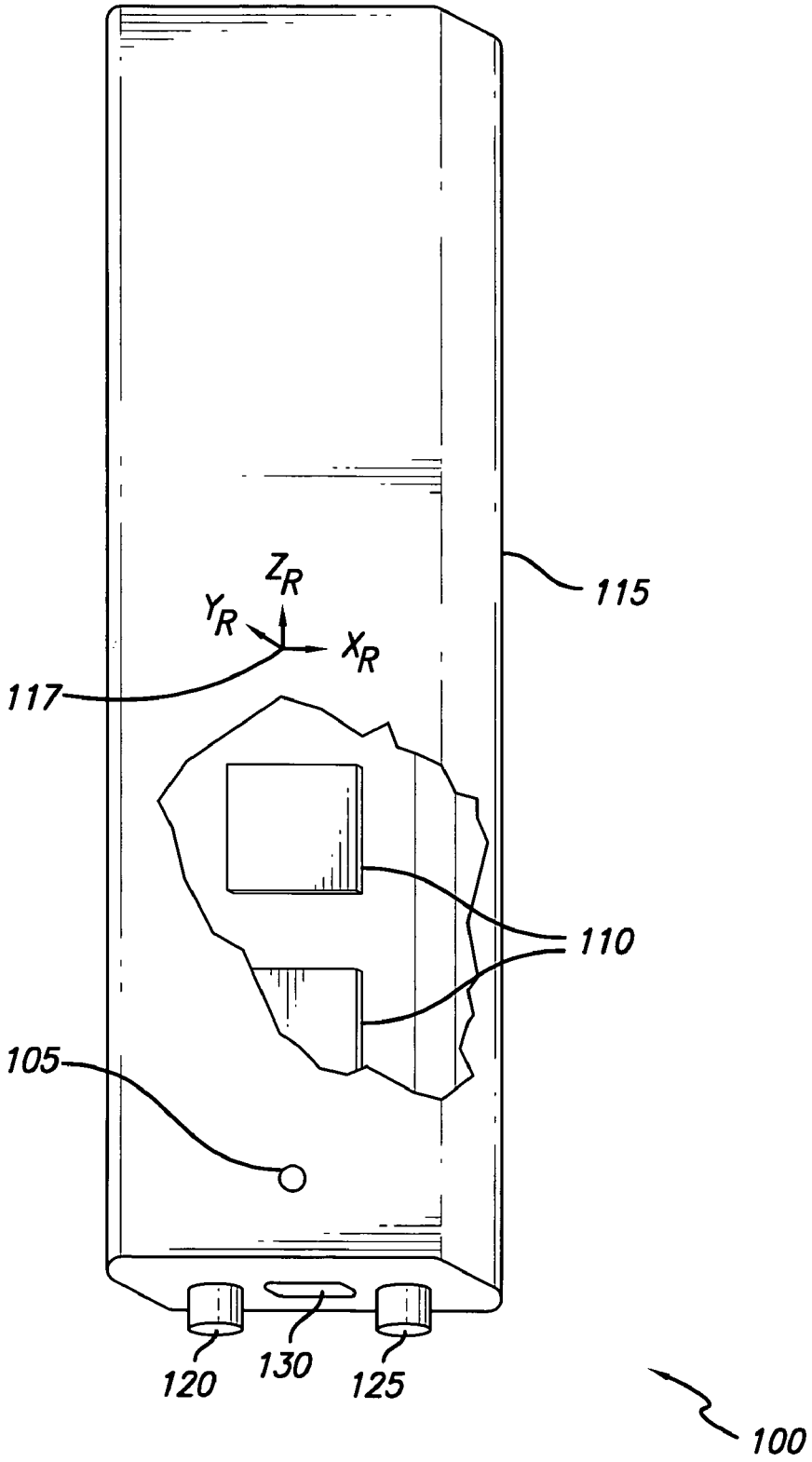
FIG. 1 depicts an antenna system comprising an internal antenna structure, and a radome with internally mounted camera in accordance with a preferred embodiment of the invention.

FIG. 1 shows a line drawing of an antenna system in accordance with the present invention. Conventional details of the antenna system are well known to those skilled in the art and will not be described in detail herein. The antenna system of the present invention incorporates a camera (105) into the antenna radome (115) within which can be found the radiating structures of the antenna (110). Suitable cameras are commercially available. Also a variety of specific camera details are well known and accordingly such details are not described in detail. The camera may be configured within the radome and only the camera lens (105) is shown in the view of FIG. 1. The camera (115) is aligned to observe the landscape directly in front of the forward face of the antenna radome (115). FIG. 1 shows the three dimensional reference axes (117) of the radome (115). These radome reference axes (117) are given as $X_R$, $Y_R$, and $Z_R$. Since the camera (105) is fixed to the radome, the pointing direction of the camera (115) is also fixed. The camera observation angle will generally be perpendicular to the $X_R/Z_R$ plane but may have down tilt in the $Y_R/Z_R$ plane. The radiation pattern boresight pointing direction of the radome internal antenna (110) could be different from the radome (115) attached camera. This pointing difference could be achieved by mechanically gimballing the antenna within the radome, by phase shifting the transmission angle of the individual radiating elements which make up the complete antenna, or by a combination of both means. For example, the teachings of patent application Ser. No. 12/074,980 filed Mar. 7, 2008, patent application Ser. No. 12/074,473 filed Mar. 4, 2008, and U.S. Pat. No. 5,949,303 describe beam pointing adjustment as well as beamwidth adjustment systems and methods which may be employed, the disclosures of which are incorporated herein by reference in their entirety.

FIG. 1 shows three connectors on the bottom of the complete antenna system (100). Two of these connectors (120, 125) represent RF connectors. In typical modern wireless antennas, one physical structure may include dual antenna polarizations, as well as multiple band operation as well. Each polarization is used for diversity receive purposes. RF signals may be transmitted out of one or both polarizations. In wireless, the radiating patterns of both diversity polarizations are matched. Those skilled in the art will appreciate that this invention also applies to antennas with only one polarization and therefore one antenna connector as well as other antenna configurations with more antenna connectors. The third connector (130) shown in FIG. 1 is used for data communication purposes. The data communication could include such items as control of the antenna pointing direction, the antenna beamwidth, and operation & maintenance of any active electronics within the antenna structure. With the present invention, this data communication port would also provide control and data acquisition from the antenna camera (105). Those skilled in the art will appreciate that data communication could also take place via the RF connectors (120, 125) by frequency duplexing a data communication channel along with the RF signals. In this latter case, the data connector (130) could be omitted. Also the disclosures of the above noted patent applications and patent incorporated herein by reference provide additional details on suitable control and RF communication links for bidirectional communication of image data from the camera to the remote user and antenna pointing and beamwidth control data to the antenna.

During antenna installation, the installer will generally mechanically attach the complete antenna (100) to a suitable antenna support structure. Attachments are generally performed on the back of the complete antenna structure (100). There may or may not be a means for the installer to point the exterior surface of the antenna radome (115) at the time of installation. For example on a typical communication tower, built for the purpose of antenna installation, such pointing is generally possible. When attaching to the side of a building, lease agreements with the building landlord may require a flush mounting. In either case the final pointing direction of the antenna radiating boresight can be difficult for the operator to determine after installation.

Figure 2:
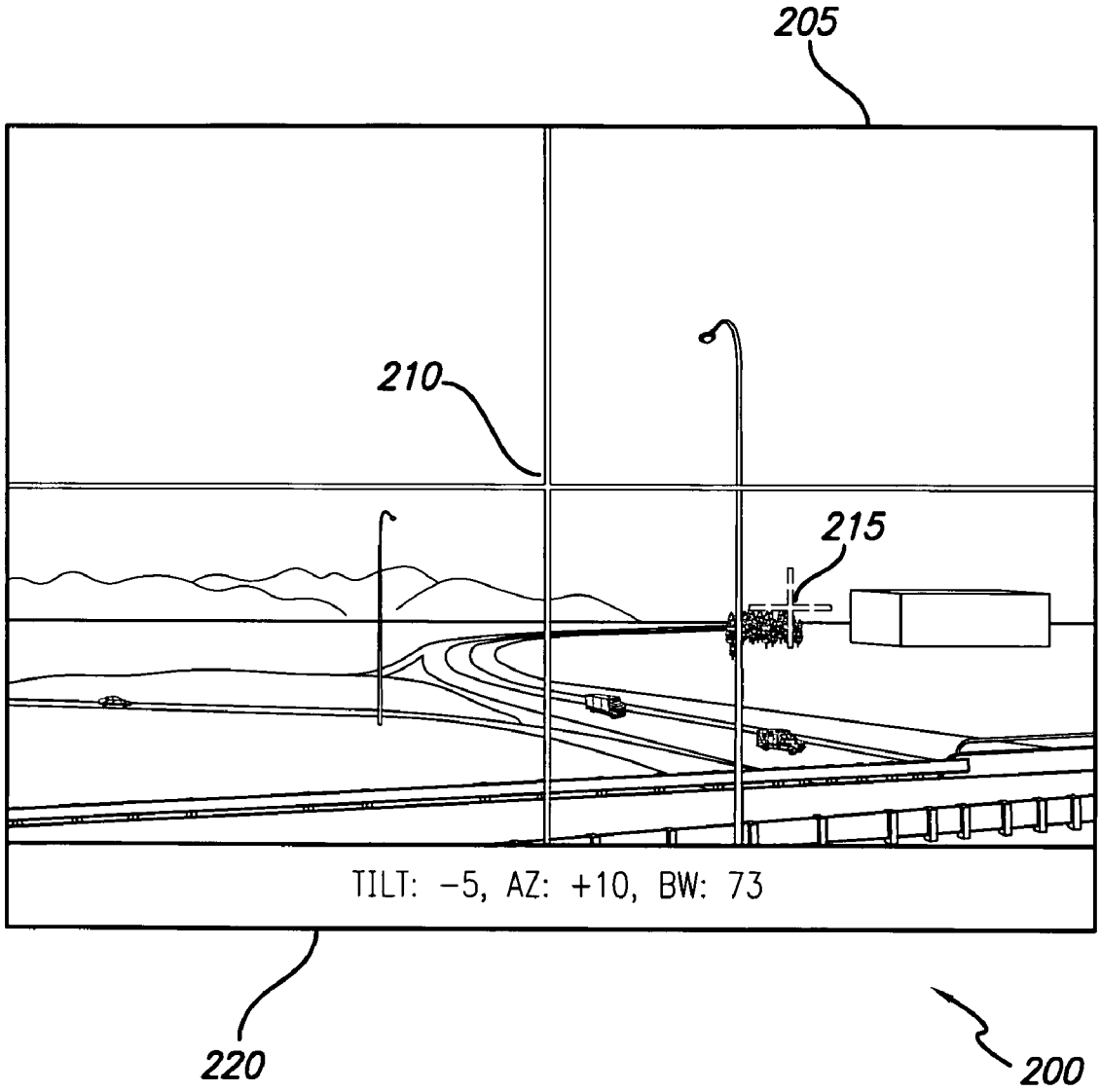
FIG. 2 is an example of an image taken from a view perpendicular to the antenna radome including gridlines with an axis indicating the nominal antenna boresight pointing, a reticle indicating the commanded boresight pointing, and a caption providing data on the reticle position relative to the gridline axis along with antenna beamwidth information.

With the present invention, after installation an operator may instruct the camera (105) to take a picture via the data communication methods described above. Data regarding the antenna boresight pointing relative to the radome axes would then be communicated to the operator over the same data path. FIG. 2 shows an example still image produced by the present invention. The image of FIG. 2 includes an antenna pointing neutral position grid (210). The neutral position of the antenna represents the boresight pointing direction when pointing controls are set to zero. The neutral position is indicated by the central grid location (210). The image includes a reticle (215) showing the actual antenna radiating pattern pointing position. The bottom of the image provides data (220) including the reticle position as well as information regarding the current beamwidth of the antenna. This beamwidth information could be static or based on controlled adjustment depending on the antenna design.

The information in FIG. 2 would be used in several ways. First, a comparison of a current image with a past image would inform the user if the antenna has moved. Such movement would cause a shift in the image captured by the camera. Second, the image permits the user to make sure the boresight of the antenna is pointed at the desired target. For example, FIG. 2 shows the antenna boresight pointed at a freeway just to the right of a lamppost. Such pointing could be aided using internet mapping software such as Google maps. Finally, the image permits the user to insure no new obstacles have obstructed the antenna coverage area.

The advantage of image provided information is the volume of the content and the simple judgments that can be based on this content. Initial correct mounting can be determined by viewing the image during and just after installation. If the borders of the image change with time, the antenna is not properly secured. If the position of the reticle changes, a change has been commanded, either intentionally or unintentionally. This information can be easily determined regardless of season.

The present invention could be used with antennas with or without pointing and beamwidth control. The above describes the advantages of using the invention on antennas with pointing and beamwidth controls. For antennas without pointing and beamwidth control, the invention would be helpful in instructing installation crews on proper mechanical alignment. Also, images from such an antenna would also show if the antenna has moved with time. For example, severe weather may cause a mounted antenna to move.

Figure 3:
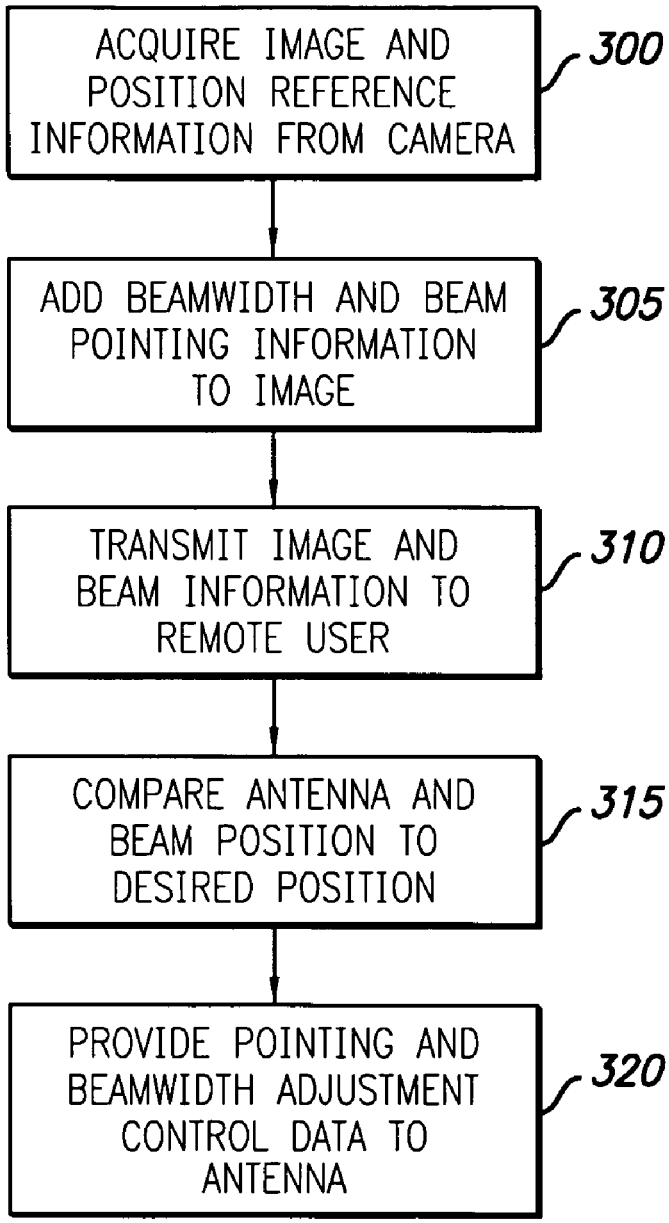
FIG. 3 is a flow diagram of an antenna position data acquisition and control method in accordance with a preferred embodiment of the invention.

It will be appreciated from the above description that in addition to an improved antenna system the present invention also provides an antenna position data acquisition and control method. Referring to FIG. 3 the control flow of the antenna position data acquisition and control method is illustrated. At 300 an image taken from the antenna mounted camera is acquired along with position reference information which may include a neutral pointing position and an indicator, such as a reticle, corresponding to actual antenna radiating pattern pointing position (beam boresight). At 305 current beamwidth and beam pointing information is added to the image data. For example this may be text display data superimposed on the image. At 310 the camera image and superimposed beam information is transmitted to the remote user via one or more of the communication connections 120, 125 and 130 as described above. At 315 the received image with beam information is compared by the remote user to a desired beam position. For example, the received image and position information can be compared to a prior image to see if the antenna or beam has moved unintentionally requiring correction. Alternatively the image may be used to determine an adjustment to a new desired pointing position, as described above. Also any changes in the environment requiring beamwidth adjustment may be determined. At 320 control data to provide the desired correction in beam pointing direction and/or beamwidth is transmitted to the antenna and received at one or more of the communication connections 120, 125 and 130. This control data is used to actuate mechanical or beam phase control to provide the desired adjustment as described above and in the applications and patents incorporated herein by reference. In an application without beam position or beamwidth control the steps 305 and 320 may be dispensed with and as noted above the antenna position information may be used during installation to correct improper mounting by the on site installation crew or monitored remotely over time to detect movement due to weather or other causes to dispatch an installation repair crew. Also such installation monitoring may also be employed in an installation method for a system having beam pointing or beamwidth control as described above.

Many specific implementations and variations in the above described embodiments will be appreciated by those skilled in the art which are purely illustrative and not limiting in nature.

What is claimed is:

1. An antenna system adapted for use in a wireless network and for remote position monitoring and control, comprising:

an antenna;

a camera mounted in a fixed relation to the antenna so as to provide a view generally in the direction of the boresight of the antenna beam; and a communication connection coupled to the camera to provide image data from the camera to a remote location, wherein said antenna comprises plural radiating elements and wherein the communication connection receives beamwidth control signals provided from the remote location.

2. An antenna system as set out in claim 1, further comprising a radome configured about the antenna and wherein the camera is mounted to the radome.

3. An antenna system as set out in claim 1, wherein the communication connection receives beam pointing direction control signals provided from the remote location.

4. A method for remote antenna positioning data acquisition, comprising:

acquiring an image of a non-moving object from a camera mounted in a fixed relation to an antenna generally in the direction of the boresight of the antenna beam;

providing the image data to a remote location; and detecting movement of the antenna from a change in image of the non-moving object.

5. A method for remote antenna positioning data acquisition as set out in claim 4, wherein the image includes position reference information.

6. A method for remote antenna positioning data acquisition as set out in claim 5, wherein the position reference information includes a camera pointing direction reference marker and a beam pointing direction reference marker.

7. A method for remote antenna positioning data acquisition as set out in claim 4, further comprising adding beam pointing position data in text format to the image data before providing the image data to the remote location.

8. A method for remote antenna positioning data acquisition as set out in claim 4, further comprising adding beamwidth information to the image data before providing the image data to the remote location.

9. A method for remote antenna positioning data acquisition as set out in claim 8, further comprising providing beamwidth adjustment control data to the antenna location from the remote location.

10. A method for remote antenna positioning data acquisition as set out in claim 4, further comprising using the image data at the remote location to determine antenna beam pointing position relative to desired pointing position.

11. A method for remote antenna positioning data acquisition as set out in claim 10, further comprising providing beam pointing adjustment control data to the antenna location from the remote location in response to the determination of antenna beam pointing position information.

12. A method for remote antenna positioning data acquisition as set out in claim 10, wherein using the image data at the remote location to determine antenna beam pointing position relative to desired pointing position comprises comparing the received image data to a prior image to see if the antenna or beam has moved unintentionally requiring correction.

13. A method for remote antenna positioning data acquisition as set out in claim 4, wherein the antenna is configured within a radome and wherein the camera is mounted to the radome.

14. A method for alignment of an antenna during installation, comprising:

mounting a camera in a fixed relation to an antenna;

mounting the antenna and camera to a support structure;

acquiring an image of a non-moving object from the camera;

comparing the pointing direction of the camera to a desired pointing direction corresponding to desired antenna positioning; and adjusting the mounting of the antenna if the image shows a deviation between desired mounting position and actual mounting position.

15. A method for alignment of an antenna during installation as set out in claim 14, wherein mounting a camera in a fixed relation to an antenna comprises mounting the camera to a radome configured about the antenna.

16. A method for alignment of an antenna during installation as set out in claim 15, wherein mounting the antenna and camera to a support structure comprises mounting the antenna and radome together to the support structure.

17. A method for alignment of an antenna during installation as set out in claim 15, wherein mounting the antenna and camera to a support structure comprises mounting the antenna and radome to a communication tower.

18. A method for alignment of an antenna during installation as set out in claim 15, wherein mounting the antenna to a support structure comprises mounting the antenna and radome to a building.

19. A method for alignment of an antenna during installation as set out in claim 14, wherein acquiring an image from the camera further comprises providing pointing reference information in the image.

* * * * *